United States Patent [19]

Kovacs et al.

[11] Patent Number: 4,475,956

[45] Date of Patent: Oct. 9, 1984

[54] METHOD OF MAKING HIGH STRENGTH FERRITIC DUCTILE IRON PARTS

[75] Inventors: Bela V. Kovacs; Roman M. Nowicki, both of Bloomfield Hills; Charles A. Stickels, Ann Arbor, all of Mich.

[73] Assignee: Ford Motor Company, Dearborn, Mich.

[21] Appl. No.: 475,679

[22] PCT Filed: Jan. 24, 1983

[86] PCT No.: PCT/US83/00113

§ 371 Date: Jan. 24, 1983

§ 102(e) Date: Jan. 24, 1983

[51] Int. Cl.[3] ..... C21D 5/14; C22C 37/04; C22C 37/10

[52] U.S. Cl. ..... 148/3; 148/35; 148/139

[58] Field of Search ..... 148/3, 35, 139; 75/123 CB, 123 L

[56] References Cited

U.S. PATENT DOCUMENTS 2,809,888 10/1957 Schelleng et al. ..... 148/139
3,055,756 9/1962 Kanter ..... 75/123 CB
3,210,183 10/1965 Ototani et al. ..... 75/123 CB
3,549,430 12/1970 Kies et al. ..... 148/35
3,954,133 5/1976 Miyaoka et al. ..... 48/35

FOREIGN PATENT DOCUMENTS 54-38968 11/1979 Japan ..... 75/123 CB
57-116749 7/1982 Japan ..... 75/123 CB

*Primary Examiner*—Peter K. Skiff
*Attorney, Agent, or Firm*—Joseph W. Malleck; Olin B. Johnson

[57] ABSTRACT

A method of strengthening ferritic ductile iron castings while maintaining ductility at a high level is disclosed. An iron alloy melt is cast consisting essentially of by weight 3.9–6.0% Si, 3.0–3.5% C, 0.1–0.3% Mn, 0–0.35% Mo, at least 1.25% Ni, no greater than 0.015% S and 0.6% P, the remainder Fe, the melt having been subjected to a nodularizing agent to form graphite nodules upon solidification. The cast alloy is heat treated to provide a fully ferritic microstructure with 9–14% by volume graphite, a yield strength of at least 75,000 psi, a tensile strength of at least 95,000 psi, and an elongation of at least 17%.

10 Claims, 2 Drawing Figures

METHOD OF MAKING HIGH STRENGTH FERRITIC DUCTILE IRON PARTS

BACKGROUND OF THE INVENTION AND PRIOR ART STATEMENT

It is conventional in the art of making ductile iron castings that when maximum ductility and the best machinability is desired, and high strength is not required, nodular iron castings are given a conventional full anneal. The microstructure is converted to ferrite and spheroidal graphite. This microstructure is called a ferritic nodular iron (the term nodular being interchangeable with ductile herein, although ductile irons can include some forms of graphite other than spherulitic); it typically possesses a yield strength of 40,000 psi, a tensile strength of 60,000 psi, an elongation of 18%, and a hardness of 137–170 BHN.

However, such ferritic nodular irons do not offer sufficient strength (at room temperature and at elevated temperatures) and corrosion resistance (at 1200° F.) to be used in many automotive applications such as engine components. It would be desirable if such irons could be enhanced in such physical properties since the casting would offer considerable manufacturing economy as compared to steel forgings which consume considerable thermal and mechanical energy in forming the final product. In addition, such casting would offer weight savings due to the presence of graphite in significant amounts.

The prior art has not attempted to achieve these enhanced physical properties (see U.S. Pat. Nos. 3,954,133 and 3,549,430).

The use of higher amounts of silicon has been investigated and it has been determined that higher quantities of silicon, up to 4%, tend to stabilize the ferritic iron against phase change at elevated temperatures; and higher quantities of silicon tend to reduce oxidation, but is limited by the uniformity of silicon microsegregation gradient. Silicon, however, as generally accepted in the art, reduces the ductility of ferritic irons at room temperature. Therefore, the prior art, for maximum toughness at ambient temperatures, has kept silicon to the lower possible level. Consequently, the maximum level of silicon for practical production has been limited by the ability to process the iron without excessive difficulty and this has usually been in the area of 2–3%.

SUMMARY OF THE INVENTION

This invention has discovered a method by which the strength of ferritic ductile iron castings can be dramatically increased and at the same time maintain ductility at a high level. The method is an economical way of making high strength ferritic ductile iron parts by essentially increasing the silicon content, far in excess of that used in normal standard chemistry for ferritic ductile iron castings, reducing the amount of manganese normally used with a ferritic ductile iron casting to a level which is essentially one-half, and adding molybdenum and nickel in quantities that provide significant solution strengthening of the casting.

The method comprises: (a) casting an iron alloy melt into substantially the shape of the desired part, the melt consisting essentially of by weight 3.9–6.0% silicon, 3.0–3.5% carbon, 0.1–0.3% manganese, 0–0.35% molybdenum, sulphur no greater than 0.015%, phosphorus no greater than 0.06%, nickel of at least 1.25%, and the remainder iron, the melt having been subjected to a nodularizing agent to form nodules of the graphite upon solidification; and (b) heat treating the cast part to provide a fully ferritic iron microstructure with 9–14% by volume graphite and having a yield strength of at least 75,000 psi, a tensile strength of at least 95,000 psi, and an elongation of at least 17%.

It is advantageous if the chemistry of said melt is limited to having 4.0–4.2% silicon, nickel in an amount of about 1.25%, and molybdenum in an amount of about 0.3%. With this chemistry the physical charactistics can be improved to levels of 80 ksi for yield strength and 100 ksi for tensile strength. It is preferred that the carbon level be in the range of 3.0–3.5 to promote spheriodal nodular iron.

Preferably, the iron is heat treated to promote a hardness of at least 220 BHN, by heating to 1600° F. for two hours, cooling at a rate of about 100° per hour to 1400° F., and holding at that latter temperature for about two hours, followed by furnace cooling at a rate of no greater than 50° per hour. Alternatively, the iron may be heat treated by isothermal subcritical annealing or by continuous cooling at a rate of 50–100° F./hr.

The resulting fully ferritic ductile iron is particularly characterized, as a composition by the presence of 1–14% by volume graphite, 86–91% ferritic iron alloy consisting essentially of 3.9–6.0% silicon, 0.1–0.3% manganese, 0–0.35% molybdenum, at least 1.25% of nickel, 0.02–0.05% Mg, and the remainder Fe. The yield strength of such ferritic nodular iron is at least 75,000 psi, a tensile strength of at least 95,000 psi, and at least 17% elongation, and about 220 BHN hardness. The ferritic ductile iron will have increased corrosion resistance because of higher silicon content and improved thermal stability because the $A_c$ temperature is higher.

DETAILED DESCRIPTION

Figure 1:
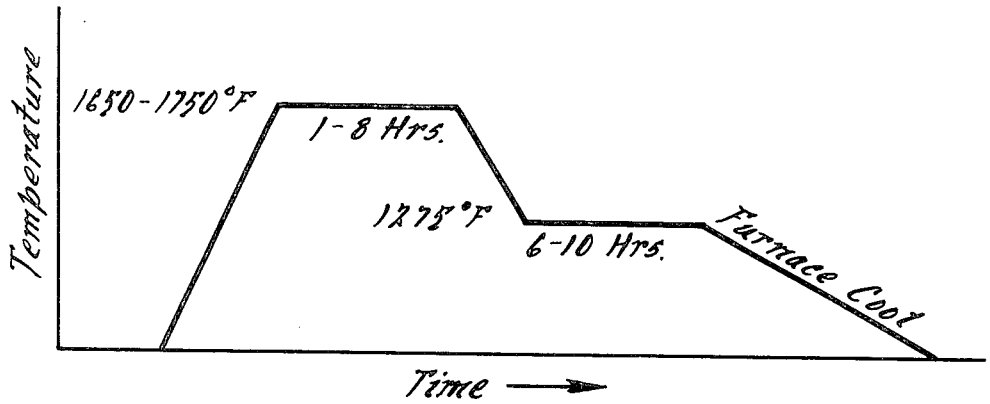
FIGS. 1 and 2 are schematic diagrams of temperature as a function time to depict, respectively, alternative heat treatments useful for the disclosed process.

Ductile iron (commonly called nodular iron) was introduced around 1948. It has been used for castings having sections from ⅛" up to 40" thick. It is conventionally produced by treating, with cerium or magnesium alloys, molten iron that normally would produce a soft, weak grey iron casting. The addition of these special alloys results in castings which have the carbon content in spheroidal form. Castings so made have relatively better ductility than ordinary grey iron. Several types of matrix structures can be developed by alloying or heat treatment, such as pearlitic or ferritic matrices.

Ferrite is defined herein to mean a microconstituent that can be essentially pure iron, or it may contain other metals which are dissolved in it to form a solid solution. Ferrite is always virtually carbon free as it can only contain less than 0.02% carbon. Ferrite is essentially a soft constituent, as exemplified by low carbon steel or ingot iron which is all ferrite. However, the ferrite of cast iron contains 1–3% silicon dissolved in it. This causes a mild increase in hardness and some increase in strength and wear resistance. A ferritic matrix is often desired in iron because of its excellent machinability.

A ferritic matrix is generally the result of an annealing heat treatment. The ferritic type grade, typical of the prior art, has a tensile strength of about 60,000 psi, yield strength of about 40,000 psi, elongation of about 18%, and a typical hardness range of 137–170 BHN; this is in the fully annealed condition. See "Gray and Ductile Iron Handbook" by Charles F. Walton, published by Gray and Ductile Iron Founders Society, 1971, p. 100–101.

A preferred method for obtaining greater strength while preserving the other physical characteristics is as follows.

1. An iron alloy melt is prepared for casting into substantially the shape of a desired part. The melt consists essentially of 3.9–6.0% silicon (preferably 4.2%), 3.0–3.5% carbon (preferably 3.0%), 0.1–0.3% manganese (preferably 0.2%), 0–0.35% molybdenum (preferably 0.30%), sulphur maintained at a maximum of 0.015%, phosphorus maintained at a maximum of 0.06%, and nickel in an amount of at least 1.25% (preferably 1.25%) by weight, the remainder being iron. Going below the required silicon content will cause the yield strength of the iron to fall below 75,000 psi. Exceeding 6.0% Si will cause the material to become more brittle and have elongation below 17% causing machining problems. Nickel below 1.25% will render inadequate solution strengthening and cause the yield strength to fall below 75,000 psi. Although greater than 5.0% Ni can be employed without affecting the desired physical properties, the cost of making the materials fails to be economical over 5.0%. Allowing Mo to exceed 0.3% causes Mo to segregate and result in more embrittlement, with elongation below 17%.

2. The cast part is then heat treated to provide a fully ferritic iron microstructure with 9–14% by volume graphite and having a yield strength of at least 75,000 psi, tensile strength of at least 95,000 psi, and an elongation of at least 17%.

For purposes of the preferred mode, heating is to 1600° F. for about 2 hours and then cooling is carried out at a rate of about 50° F. per hour to a temperature level of 1400° F. The casting is held at this temperature of 1400° F. for a period of about 2 hours and then furnace cooled to room temperature. Furnace cooling is at a rate of about 50°–100° F./hr.

Addition of 4.2% silicon, 1.25% nickel, and 0.3% molybdenum to standard chemistry for ductile iron with ferrite annealing heat treatment results in at least a doubling of the yield strength without reducing the elongation. The ferritization heat treatment may be achieved by continuous cooling at a rate of 50°–100° F./hr or by isothermal subcritical annealing. Strength properties are similar for both processes.

Other techniques for ferritic annealing of nodular iron comprise, first (see FIG. 1), heating the casting to a temperature of 1650°–1750° F. for a period of time of one hour plus one hour or more per inch of the section thickness, which typically may range up to eight hours. The casting is then cooled to 1275° F. in any convenient manner, but uniformly, if residual stress is to be avoided, and held at 1275° F. for a period of about five hours plus one hour per inch of casting section (typically 6–10 hours), and then furnace cooled to room temperature.

Figure 2:
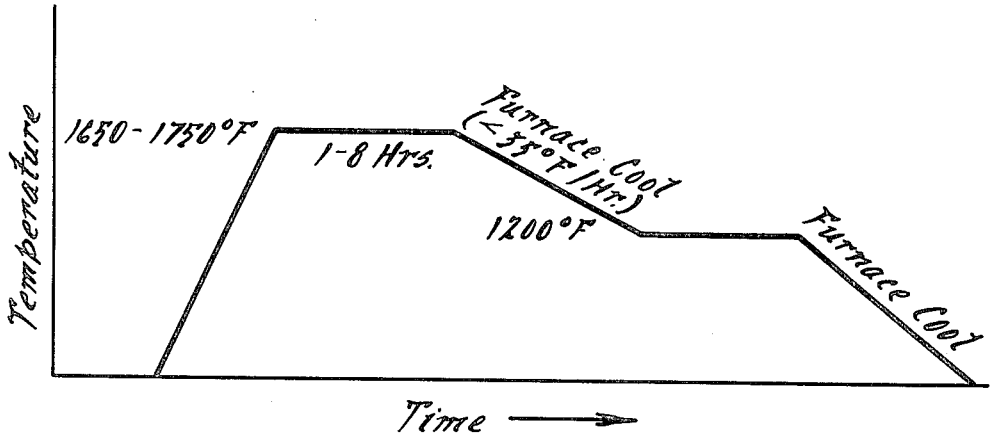

A second technique is to heat (see FIG. 2) to a temperature level of 1650°–1750° F. for the same period as in the first case, and then cooled to 1200° F. at a cooling rate when the temperature is dropping between 450° and 1200°, which does not exceed a rate of 35° F. per hour. The casting is then held at 1200° F., as above, for five hours plus one hour per inch of casting section, and then furnace cooled to room temperature.

The ferritization of the iron composition is enhanced by the high amount of silicon that is present. Silicon segregation causes the catalytic acceleration of carbon diffusion. Thus ferritization is accelerated significally compared with ferritization in a conventional composition of nodular iron.

Both molybdenum and nickel play important roles by contributing to solution strengthening. Molybdenum and nickel may be interchanged; molybdenum may be lowered and may even be absent, while nickel can be increased.

The resulting iron composition is a fully ferritic ductile iron comprising 9–11% by volume graphite and 89–91% ferritic iron alloy, said alloy containing 3.9–6.0% silicon, 0.1–3% manganese, 0–35% molybdenum, no greater than 0.015% sulphur, no greater than 0.06% phosphorus, and nickel in an amount of 1.25–5.0%, said iron having a yield strength of at least 75,000 psi, a tensile strength of at least 95,000 psi, and an elongation of at least 17%. Preferably the ductile iron composition has a hardness of about 220 BHN.

The mechanical properties of high ductility and high strength, consistent with good machinability, are extremely attractive in this new type of ferritic nodular iron.

The cost of producing an iron part from this material is considerably decreased in comparison to an equivalent forged part. A significant amount is saved by eliminating the heating and mechanical working associated with forging and another amount is saved by using less iron material to do an equivalent task.

A series of samples were prepared varying the chemistry of the ferritic ductile iron. Each sample contained about by weight 0.2% Mn, 3.0% carbon, and below the maximum of 0.015% suphur and .06% for phosphorus. Each sample melt was nodularized with magnesium so that the resulting cast iron contained 0.02–0.05% Mg and a high content of spherulitic graphite. The samples were all given a ferritizing heat treatment in accordance with the preferred mode and were tested for strength and elongation, the results of which are shown in Table I below.

TABLE I

| Sample | Si | Ni | Mo | 100% Ferritic Iron | Yield Strength >75 ksi | Elongation >than 17% |
|---|---|---|---|---|---|---|
| 1 | 4.2 | 1.2 | .3 | Yes | Yes | Yes |
| 2 | 3.0 | 1.2 | .3 | Yes | No | Yes |
| 3 | 8.0 | 1.2 | .3 | Yes | Yes | No (more brittle) |
| 4 | 4.2 | .75 | .3 | Yes | No | Yes |
| 5 | 4.2 | 1.2 | 1.0 | Yes | Yes | No (more brittle) |

We claim:

1. A method of making high strength ferritic ductile iron parts, comprising:

(a) casting an iron alloy melt in substantially the shape of the desired part, said melt consisting essentially of by weight 3.9–6.0% silicon, 3.0–3.5% carbon, 0.1–0.3% manganese, 0–0.35% molybdenum, no greater than .015% sulphur, no greater than 0.06% phosphorus, and nickel in an amount of at least 1.25%, an increased amount of Mo being present for a decreased amount of nickel so that when Ni is at the low end of its permitted range, Mo will be at its high end of permitted range, and the remainder iron, said mnelt having been subjected to nodularized agent to form nodules of graphite upon solidification;

(b) heat treating said cast part to provide a fully ferritic ductile iron microstructure with 9–14% by volume graphite and a ferritic matrix containing Mo and Ni in solid solution, said iron having a yield strength of at least 75,000 psi, a tensile strength of at least 95,000 psi, and an elongation of at least 17%.

2. The method as in claim 1, in which said silicon is 4–4.2% by weight of the melt.

3. The method as in claim 1, in which said nickel is about 1.25% and said molybdenum is about 0.3%.

4. The method as in claim 1, in which said ductile iron is nodular iron containing spheroidal graphite.

5. The method as in claim 1, in which said ductile iron has a nickel content limited to 1.25–5.0% by weight.

6. The method as in claim 1, in which said cast part has a hardness of at least 220 BHN, and said heat treating is specifically carried out by heating to 1600° F. for at least two hours, cooling at a rate of 100° F. per hour to 1400° F., holding for about two hours, and furnace cooling at a rate no greater than 50° per hour.

7. The method as in claim 1, in which said heat treating is carried out by use of isothermal subcritical annealing.

8. The method as in claim 1, in which said heat treating is carried out by heating to a temperature of at least 1600° F. for a period of at least two hours, and then continuously cooling at a rate of 50–100° F. per hour to room temperature.

9. A high strength ferritic ductile iron composition, consisting of by weight 3.9–6.0% silicon, 3.0–3.5% C., 0.1–0.3% Mn, about 0.3% Mo, at least 1.25% Ni, 0.02–0.05% Mg, no greater than 0.015% sulphur, and no greater than 0.06% phosphorus, and the remainder essentially iron, the iron containing 9–14% by volume spheroidal graphite and 86–91% ferritic iron alloy with Mo and Ni being in solid solution, said iron having a yield strength of at least 75,000 psi, a tensile strength of at least 95,000 psi, and an elongation of a least 17%.

10. The iron composition of claim 9, in which said iron has a hardness of about 220 BHN and nickel is limited to 1.25–5.0% by weight.

* * * * *